US007847530B2

(12) United States Patent
Takagi

(10) Patent No.: US 7,847,530 B2
(45) Date of Patent: Dec. 7, 2010

(54) VOLTAGE REGULATOR

(75) Inventor: Yoshiki Takagi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 440 days.

(21) Appl. No.: 12/090,407

(22) PCT Filed: Jul. 27, 2007

(86) PCT No.: PCT/JP2007/065219

§ 371 (c)(1),
(2), (4) Date: Apr. 16, 2008

(87) PCT Pub. No.: WO2008/026420

PCT Pub. Date: Mar. 6, 2008

(65) Prior Publication Data

US 2009/0278518 A1 Nov. 12, 2009

(30) Foreign Application Priority Data

Aug. 31, 2006 (JP) ..... 2006-235881

(51) Int. Cl.
*G05F 1/565* (2006.01)

(52) U.S. Cl. ..... 323/280; 323/284; 327/546

(58) Field of Classification Search ..... 323/272–280, 323/282–286, 268, 266; 327/541–546; 363/17–19
See application file for complete search history.

(56) References Cited

U.S. PATENT DOCUMENTS

| | | | | |
|---|---|---|---|---|
| 5,442,277 | A | 8/1995 | Mori et al. | |
| 5,731,731 | A * | 3/1998 | Wilcox et al. | 327/403 |
| 5,773,966 | A * | 6/1998 | Steigerwald | 323/284 |
| 7,196,504 | B2 * | 3/2007 | Itoh | 323/280 |
| 7,199,565 | B1 * | 4/2007 | Demolli | 323/273 |
| 7,443,229 | B1 * | 10/2008 | Vinciarelli et al. | 327/531 |
| 2002/0149036 | A1 | 10/2002 | Yabe | |
| 2004/0080363 | A1 | 4/2004 | Yabe | |
| 2004/0130305 | A1 | 7/2004 | Agari et al. | |
| 2006/0148416 | A1 | 7/2006 | Harasawa et al. | |

FOREIGN PATENT DOCUMENTS

| | | |
|---|---|---|
| JP | 6-295211 | 10/1994 |
| JP | 2002-312043 | 10/2002 |
| JP | 2002-373942 | 12/2002 |
| JP | 3710468 | 8/2005 |
| JP | 2006-133935 | 5/2006 |
| JP | 2006-190021 | 7/2006 |

* cited by examiner

*Primary Examiner*—Rajnikant B Patel
(74) *Attorney, Agent, or Firm*—Dickstein Shapiro LLP

(57) ABSTRACT

A voltage regulator is disclosed that includes first and second output transistors each outputting a current from the input terminal to the output terminal of the voltage regulator; and a control circuit part controlling the operations of the first and second output transistors to equalize a voltage proportional to an output voltage with a reference voltage. The control circuit part includes first and second error amplifier circuits each amplifying and outputting the difference between the proportional and reference voltages. The second error amplifier circuit consumes a smaller amount of current than the first error amplifier circuit. The control circuit part controls the output voltage by controlling the operations of the first and second output transistors using the first error amplifier circuit or controlling the operation of the second output transistor using the second error amplifier circuit in accordance with a control signal externally input to the control circuit part.

12 Claims, 5 Drawing Sheets

VOLTAGE REGULATOR

TECHNICAL FIELD

The present invention relates generally to voltage regulators, and more particularly to a voltage regulator that has the function of switching between a high-speed operating mode and a low-current-consumption operating mode.

BACKGROUND ART

Conventional voltage regulators include those having a circuit configuration that consumes a large amount of current in order to improve power supply rejection ratio (PSRR), or ripple rejection, and load transient response and those having a circuit configuration whose current consumption is reduced because of no need for a high-speed response capability.

If an apparatus having an operating state where the apparatus operates with normal current consumption and a standby state such as a sleep mode where current consumption is reduced, such as a cellular phone, uses a voltage regulator having high response speed, the voltage regulator unnecessarily consumes a large amount of current in the standby state where no high response speed is required.

FIG. 1 is a diagram showing a circuit of a conventional voltage regulator. (See, for example, Patent Document 1.)

The voltage regulator of FIG. 1 includes a first error amplifier circuit 101 that consumes a large amount of current but operates at high speed, a second error amplifier circuit 102 whose current consumption is reduced, a reference voltage generator circuit 103, and a control unit 104.

Referring to FIG. 1, the first error amplifier circuit 101 and the second error amplifier circuit 102 have control signals input thereto from the control unit 104. Each of the first error amplifier circuit 101 and the second error amplifier circuit 102 exclusively starts or stops operating in response to the corresponding control signal. When the first error amplifier circuit 101 and the second error amplifier circuit 102 stop operating, their current consumption is reduced.

In the case of a heavy load operation mode outputting a large current from an output terminal 105, the first error amplifier circuit 101 is put into operation while the operation of the second error amplifier circuit 102 is stopped. As a result, an output transistor M101 is controlled by the first error amplifier circuit 101. Accordingly, the voltage regulator can operate at high speed although a large amount of current is consumed.

On the other hand, in the case of a light load operation mode outputting a small amount of current from the output terminal 105, the operation of the first error amplifier circuit 101 is stopped while the second error amplifier circuit 102 is put into operation. As a result, the output transistor M101 is controlled by the second error amplifier circuit 102. Accordingly, the voltage regulator can reduce current consumption.

In the voltage regulator of FIG. 1, however, since the number of output transistors is one, the output transistor M101 is large in device size so as to allow a maximum current at the time of the heavy load operation mode. Therefore, the output transistor M101 has a large gate capacitance for using the large-size transistor.

Controlling this output transistor M101 with the second error amplifier circuit 102 consuming a small amount of current results in a reduced transient response to a variation in output voltage. This causes a problem if the transient response characteristic is required at the time of the light load operation mode as well.

Therefore, in order to solve this problem, there is proposed a voltage regulator as shown in FIG. 2. (See, for example, Patent Document 2.)

The voltage regulator of FIG. 2 includes a first error amplifier circuit 111 that consumes a large amount of current but operates at high speed, and a second error amplifier circuit 112 whose current consumption is reduced. The first error amplifier circuit 111 controls the operation of a first output transistor M111, and the second error amplifier circuit 112 controls the operation of a second output transistor M112, which is remarkably smaller in device size than the first output transistor M111.

Each of the first error amplifier circuit 111 and the second error amplifier circuit 112 exclusively starts or stops operating in response to a control signal input to its control signal input. In FIG. 2, reference numeral 113 denotes a comparator circuit, reference numeral 114 denotes a reference voltage generator circuit, reference numeral 115 denotes a delay circuit, and reference numeral 116 denotes an OR circuit.

In the voltage regulator of FIG. 2, the first error amplifier circuit 111 is put into operation and the operation of the second error amplifier circuit 112 is stopped at the time of a heavy load operation mode with a large load current, and the operation of the first error amplifier circuit 111 is stopped and the second error amplifier circuit 112 is put into operation at the time of a light load operation mode with a small load current. That is, the second output transistor M112 having a small device size is used as an output transistor in the light load operation mode. This reduces the gate capacitance of the output transistor, so that it is possible to respond at high speed although the current consumption of the error amplifier circuit is reduced.

[Patent Document 1] Japanese Laid-Open Patent Application No. 2002-312043

[Patent Document 2] Japanese Patent No. 3710468

In the case of FIG. 2, however, one of the output transistors M111 and M112 is always kept from operating, which results in poor efficiency. Further, even the output transistor M112 that operates at the time of a small load current occupies a much larger space than common transistors, which causes an increase in chip size. Further, in the case of FIG. 2, two PMOS transistors M113 and M114 are required as transistors for detecting a load current, which causes the problem of an increase in circuit size.

DISCLOSURE OF THE INVENTION

Embodiments of the present invention may solve or reduce one or more of the above-described problems.

According to one aspect of the present invention, there is provided a voltage regulator in which one or more of the above-described problems may be solved or reduced.

According to one aspect of the present invention, there is provided a voltage regulator that can reduce current consumption and chip area at the same time with a simple circuit and achieve a good transient response to output voltage at the time of a light load operation mode as well.

According to one embodiment of the present invention, there is provided a voltage regulator converting an input voltage input to an input terminal into a predetermined constant voltage, and outputting the converted voltage from a predetermined output terminal as an output voltage, the voltage regulator including: a first output transistor configured to output a first current according to an input first control signal from the input terminal to the output terminal; a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output a difference between the proportional voltage and the reference voltage and a second error amplifier circuit configured to amplify and output the difference between the proportional voltage and the reference voltage, the second error amplifier circuit being configured to consume a smaller amount of current than the first error amplifier circuit, wherein the control circuit part is configured to control the output voltage by performing, in accordance with an externally input external control signal, one of controlling the operations of the first output transistor and the second output transistor using the first error amplifier circuit and controlling the operation of the second output transistor using the second error amplifier circuit.

According to the above-described voltage regulator, the output voltage is controlled by controlling the operations of the first output transistor and the second output transistor using the first error amplifier circuit or by controlling the operation of the second output transistor using the second error amplifier circuit, in accordance with an externally input external control signal.

As a result, when a large current is output from the output terminal, the output voltage is controlled with both the first output transistor and the second output transistor using the first error amplifier circuit, which consumes a large amount of current but operates at high speed. On the other hand, when a small current is output from the output terminal, it is possible to control the output voltage with the second output transistor using the second error amplifier circuit that consumes a small amount of current.

Accordingly, it is possible to reduce current consumption and chip area at the same time with a simple circuit, and by making the second output transistor smaller in size than the first output transistor, it is possible to achieve a good transient response to the output voltage also at the time of a light load operation mode in which a small current is output from the output terminal.

According to one aspect of the present invention, there is provided a voltage regulator converting an input voltage input to an input terminal into a predetermined constant voltage, and outputting the converted voltage from a predetermined output terminal as an output voltage, the voltage regulator including: a first output transistor configured to output a first current according to an input first control signal from the input terminal to the output terminal; a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output a difference between the proportional voltage and the reference voltage and a second error amplifier circuit configured to amplify and output the difference between the proportional voltage and the reference voltage, the second error amplifier circuit being configured to consume a smaller amount of current than the first error amplifier circuit, wherein the control circuit part is configured to determine a magnitude of a current output from the output terminal based on a voltage at a control electrode of the second output transistor, and to control the output voltage by performing, in accordance with a result of the determination, one of controlling the operations of the first output transistor and the second output transistor using the first error amplifier circuit and controlling the operation of the second output transistor using the second error amplifier circuit.

According to the above-described voltage regulator, the magnitude of a current output from the output terminal is determined based on a voltage at the control electrode of the second output transistor, and the output voltage is controlled by controlling the operations of the first output transistor and the second output transistor using the first error amplifier circuit or by controlling the operation of the second output transistor using the second error amplifier circuit, in accordance with the result of the determination. As a result, it is possible to produce the same effects as those described above, and also to automatically switch between a light load operation mode in which only the second output transistor is used and a heavy load operation mode in which the first output transistor and the second output transistor are used.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description is given below, with reference to the accompanying drawings, of embodiments of the present invention.

First Embodiment

Figure 3:
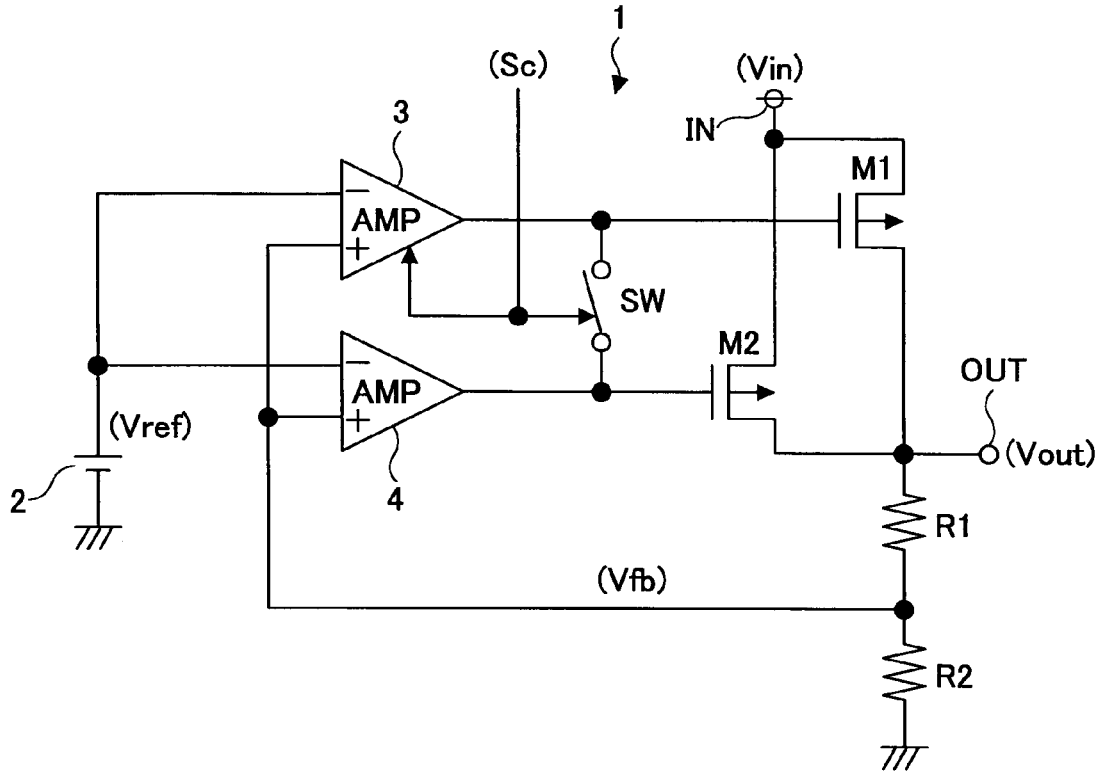
FIG. 3 is a circuit diagram showing a voltage regulator according to a first embodiment of the present invention.

FIG. 3 is a circuit diagram showing a voltage regulator 1 according to a first embodiment of the present invention.

According to the voltage regulator 1 shown in FIG. 3, an input voltage Vin input to an input terminal IN is lowered and converted into a predetermined constant voltage so as to be output from an output terminal OUT as an output voltage Vout.

The voltage regulator 1 includes a reference voltage generator circuit 2 that generates and outputs a predetermined reference voltage Vref; a first error amplifier circuit 3 that consumes a large amount of current but operates at high speed; a second error amplifier circuit 4 whose current consumption is reduced; a first output transistor M1 formed of a PMOS transistor capable of driving a large current and large in device size; a second output transistor M2 formed of a PMOS transistor much smaller in current driving capability and in device size than the first output transistor M1; a resistor R1 and a resistor R2 for output voltage detection; and a switch SW.

The reference voltage generator circuit 2, the first error amplifier circuit 3, the second error amplifier circuit 4, the resistors R1 and R2, and the switch SW may form a control circuit part. Further, the voltage regulator 1 may be integrated into a single IC.

The first output transistor M1 and the second output transistor M2 are connected in parallel between the input terminal IN and the output terminal OUT. The gate of the first output transistor M1 is connected to the output of the first error amplifier circuit 3. Further, the gate of the second output transistor M2 is connected to the output of the second error amplifier circuit 4, and the switch SW is connected between the gate of the first output transistor M1 and the gate of the second output transistor M2.

An external control signal Sc is externally input to the control signal input terminal of each of the first error amplifier circuit 3 and the switch SW, so that the operations of the first error amplifier circuit 3 and the switch SW are controlled by the external control signal Sc.

The resistors R1 and R2 are connected in series between the output terminal OUT and ground. A divided voltage Vfb generated by dividing the output voltage Vout is output from the connection of the resistors R1 and R2 to the non-inverting input of each of the first error amplifier circuit 3 and the second error amplifier circuit 4. The reference voltage Vref is input to the inverting input of each of the first error amplifier circuit 3 and the second error amplifier circuit 4.

According to this configuration, the second error amplifier circuit 4 constantly operates irrespective of the external control signal Sc. In the case of a light load operation mode such as a sleep mode, in which a small current is output from the output terminal OUT, the external control signal Sc becomes, for example, HIGH (high-level), so that the switch SW is turned OFF to be open and the first error amplifier circuit 3 stops operating, thus cutting the current consumed in the first error amplifier circuit 3. The second error amplifier circuit 4 amplifies the voltage difference between the reference voltage Vref and the divided voltage Vfb, and outputs the amplified voltage difference to the gate of the second output transistor M2 so as to control the operation of the second output transistor M2 so that the divided voltage Vfb is equalized with the reference voltage Vref. That is, at the time of the light load operation mode, since the output voltage Vout is controlled by the second error amplifier circuit 4 and the second output transistor M2, the voltage regulator 1 operates with low current consumption. As described above, the second output transistor M2 is smaller in device size than the first output transistor M1, and therefore, has a smaller gate capacitance. Accordingly, it is possible to prevent reduction in transient response at the time of the light load operation mode.

Next, in the case of a heavy load operation mode in which a large current is output from the output terminal OUT, the external control signal Sc becomes, for example, LOW (low-level), so that the switch SW is turned ON to be closed and the first error amplifier circuit 3 is put into operation. The gate of the first output transistor M1 and the gate of the second output transistor M2 are connected by the switch SW. Therefore, the first error amplifier circuit 3 simultaneously controls both the first output transistor M1 and the second output transistor M2. The first error amplifier circuit 3 amplifies the voltage difference between the reference voltage Vref and the divided voltage Vfb, and outputs the amplified voltage difference to the gate of each of the first output transistor M1 and the second output transistor M2 so as to control the operations of the first output transistor M1 and the second output transistor M2 so that the divided voltage Vfb is equalized with the reference voltage Vref. At this point, the operation of the second error amplifier circuit 4 may be stopped. However, since the first error amplifier circuit 3 dominantly controls the output voltage Vout, it causes no problem to leave the second error amplifier circuit 4 operating; rather, the heavy load operation mode smoothly switches to the light load operation mode with the second error amplifier circuit 4 constantly operating.

Figure 1:
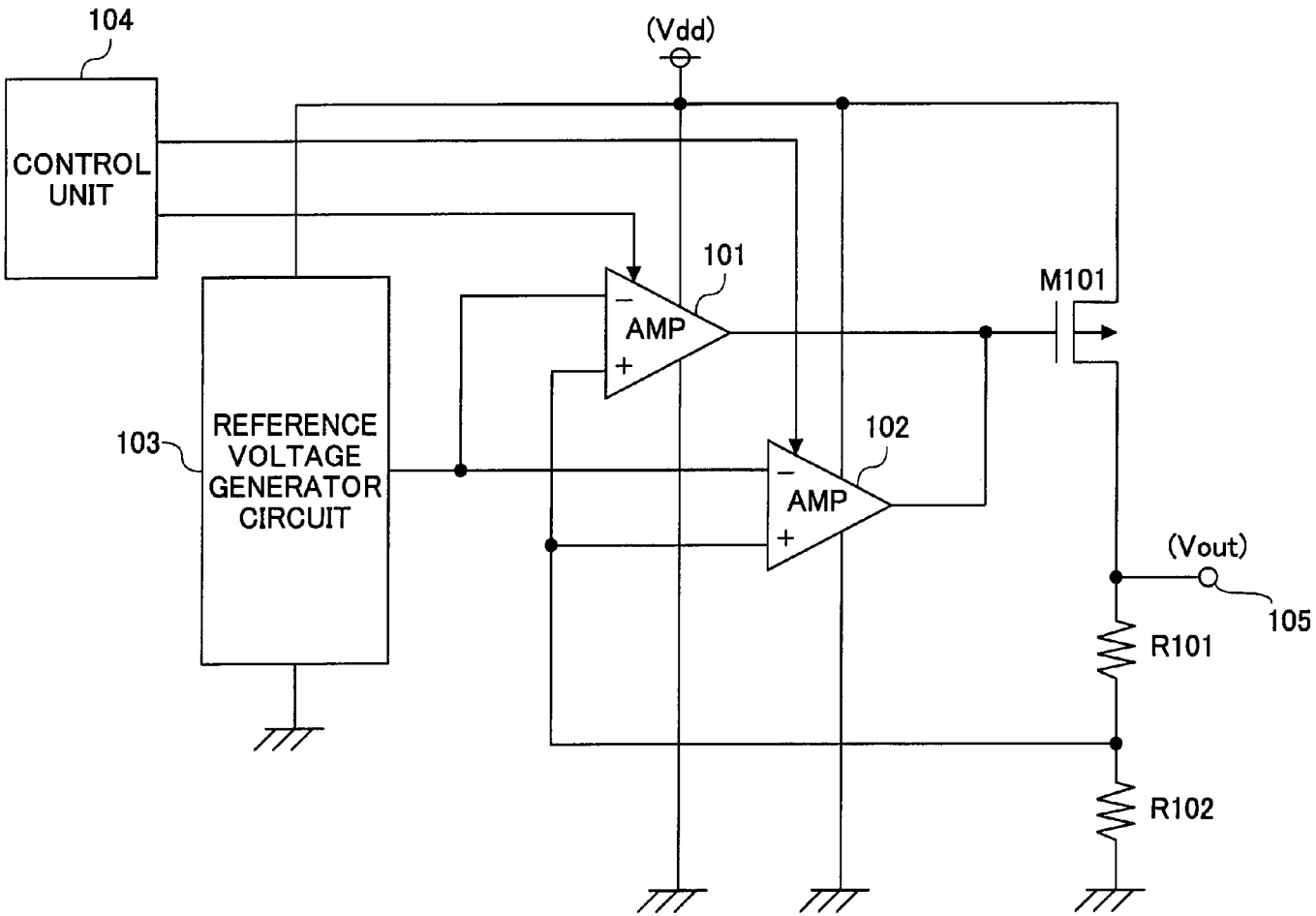
FIG. 1 is a circuit diagram showing a conventional voltage regulator.
Figure 2:
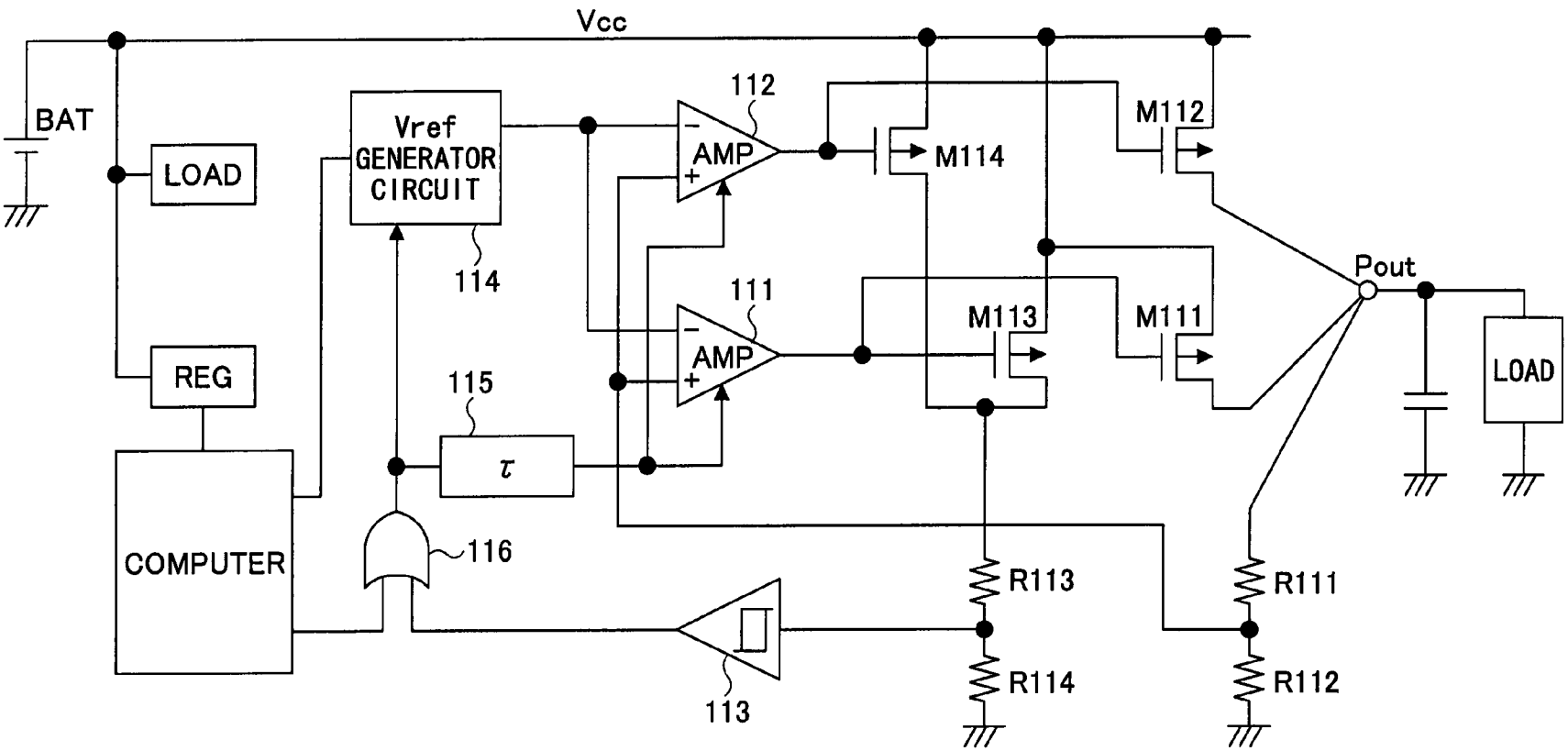
FIG. 2 is a circuit diagram showing another conventional voltage regulator.

Here, letting the current driving capability of the output transistor required in the heavy load operation mode be 10, conventionally, for example, in the voltage regulator of FIG. 2, the first output transistor M111 is required to have a current driving capability of 10. Meanwhile, according to the first embodiment of the present invention, letting the current driving capability of the second output transistor M2 be 2, the first output transistor M1 may have a current driving capability of 8. Thus, the first output transistor M1 can be reduced in size and chip area.

Thus, according to the voltage regulator 1 of the first embodiment of the present invention, the first error amplifier circuit 3, which consumes a large amount of current but operates at high speed, simultaneously controls both the first output transistor M1 and the second output transistor M2 in the heavy load operation mode, while in the light load operation mode, the operation of the first error amplifier circuit 3 is stopped to reduce current consumption, and only the second output transistor M2 small in transistor size is controlled using the second error amplifier circuit 4, which consumes a small amount of current. Accordingly, it is possible to reduce current consumption and chip area at the same time with a simple circuit, and to achieve a good transient response to output voltage at the time of the light load operation mode as well.

Second Embodiment

In the above-described first embodiment, the operations of the first error amplifier circuit 3 and the switch SW are controlled in accordance with the external control signal Sc. Alternatively, an automatic switch circuit that controls the operations of the first error amplifier circuit 3 and the switch SW in accordance with the gate voltage of the second output transistor M2 may be provided, which is described below as a second embodiment of the present invention.

Figure 4:
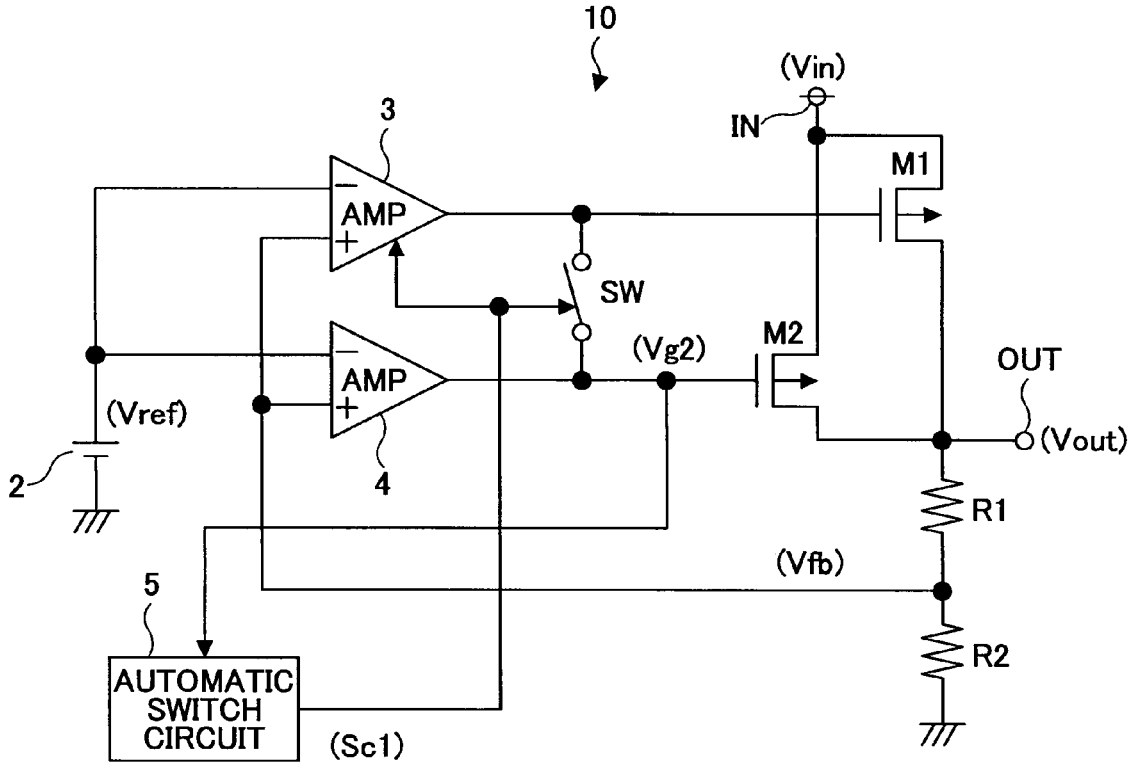
FIG. 4 is a circuit diagram showing a voltage regulator according to a second embodiment of the present invention.

FIG. 4 is a circuit diagram showing a voltage regulator 10 according to the second embodiment of the present invention. In FIG. 4, the same elements as those of FIG. 3 are referred to by the same reference numerals, and a description thereof is omitted.

In FIG. 4, a difference from FIG. 3 lies in that an automatic switch circuit 5 that generates a control signal for controlling the operations of the first error amplifier circuit 3 and the switch SW is provided.

According to the voltage regulator 10 shown in FIG. 4, an input voltage Vin input to the input terminal IN is lowered and converted into a predetermined constant voltage so as to be output from the output terminal OUT as an output voltage Vout.

The voltage regulator 10 includes the reference voltage generator circuit 2, the first error amplifier circuit, the second error amplifier circuit 4, the first output transistor M1, the second output transistor M2, the resistors R1 and R2, the switch SW, and the automatic switch circuit 5. The automatic switch circuit 5 controls the operations of the first error amplifier circuit 3 and the switch SW in accordance with a gate voltage Vg2 of the second output transistor M2.

The reference voltage generator circuit 2, the first error amplifier circuit 3, the second error amplifier circuit 4, the resistors R1 and R2, the switch SW, and the automatic switch circuit 5 may form a control circuit part. Further, the voltage regulator 10 may be integrated into a single IC.

The gate voltage Vg2 of the second output transistor M2 is input to the automatic switch circuit 5. The automatic switch circuit 5 generates a control signal Sc1 in accordance with the gate voltage Vg2, and outputs the generated control signal Sc1 to the control signal input of each of the first error amplifier circuit 3 and the switch SW. The operations of the first error amplifier circuit 3 and the switch SW are controlled by the control signal Sc1.

Figure 5:
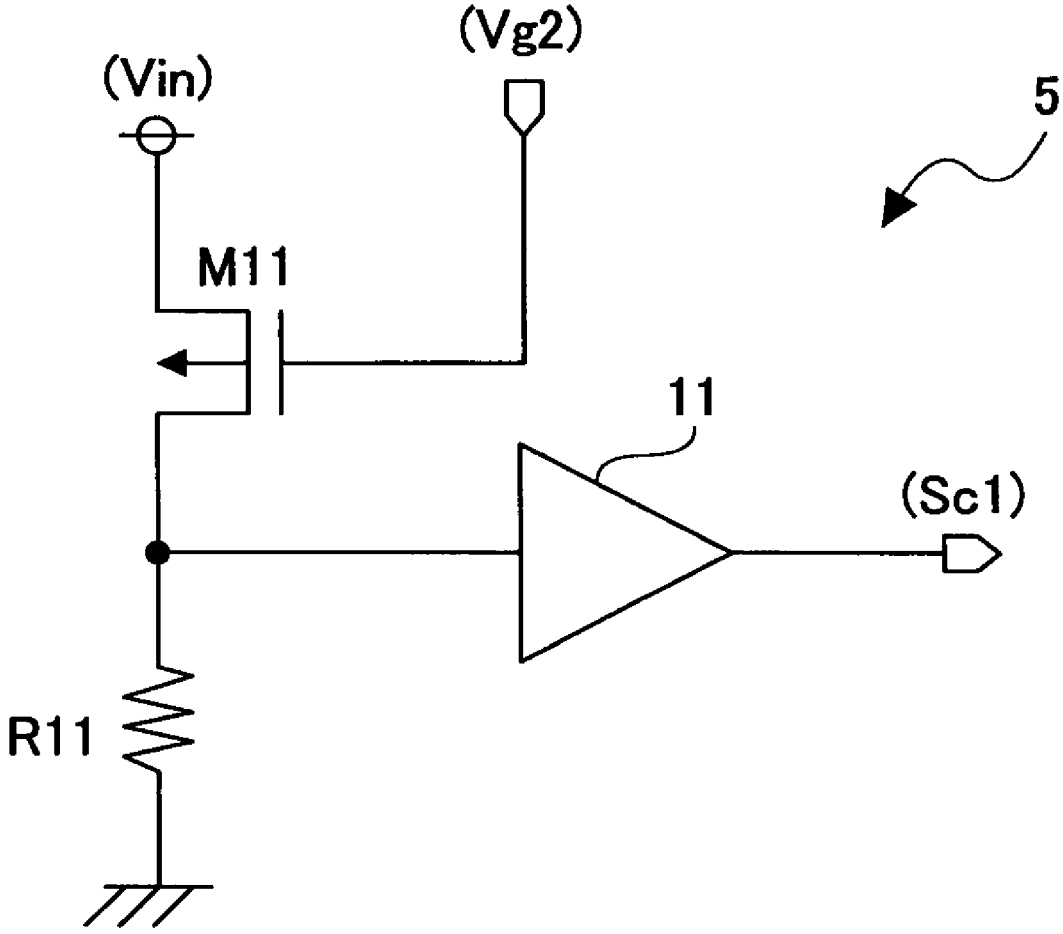
FIG. 5 is a circuit diagram showing an automatic switch circuit of FIG. 4 according to the second embodiment of the present invention.

FIG. 5 is a diagram showing a circuit configuration of the automatic switch circuit 5.

Referring to FIG. 5, the automatic switch circuit 5 includes a PMOS transistor M11 for outputting a current proportional to a current output from the output terminal OUT, a resistor R11 that converts the output current of the PMOS transistor M11 into voltage, and a buffer 11 that converts the voltage generated by the resistor R11 into a binary signal. The PMOS transistor M11 and the resistor R11 are connected in series between the input voltage Vin and ground. The gate voltage Vg2 of the second output transistor M2 is input to the gate of the PMOS transistor M11. The connection of the PMOS transistor M11 and the resistor R11 is connected to the input of the buffer 11, and the control signal Sc1 is output from the output of the buffer 11.

According to the automatic switch circuit 5 thus configured, if the gate voltage Vg2 exceeds a predetermined voltage V1 (that is, if a current output from the output terminal OUT is less than a predetermined value), the control signal Sc1 becomes, for example, HIGH (high-level), so that the switch SW is turned OFF to be open and the operation of the first error amplifier circuit 3 is stopped, thus setting a light load operation mode. Therefore, the current consumed in the first error amplifier circuit 3 is cut.

Next, if the gate voltage Vg2 becomes lower than or equal to the predetermined voltage V1 (that is, if the current output from the output terminal OUT is greater than or equal to the predetermined value), the automatic switch circuit 5 sets the control signal Sc1 LOW (low-level) in order to switch from the light load operation mode to a heavy load operation mode. Therefore, the switch SW is turned ON to be closed and the first error amplifier circuit 3 is put into operation. Since the gate of the first output transistor M1 and the gate of the second output transistor M2 are connected by the switch SW, the first error amplifier circuit 3 simultaneously controls both the first output transistor M1 and the second output transistor M2.

In the automatic switch circuit 5, the voltage value of the gate voltage Vg2 at the time of switching from the light load operation mode to the heavy load operation mode and the voltage value of the gate voltage Vg2 at the time of switching from the heavy load operation mode to the light load operation mode may be provided with hysteresis. In this case, a hysteresis comparator may be used in place of the buffer 11 of FIG. 5.

Thus, according to the voltage regulator 10 of the second embodiment of the present invention, it is possible to produce the same effects as in the first embodiment, and it is possible to automatically switch between the light load operation mode and the heavy load operation mode. Further, while a circuit that switches between the first error amplifier circuit 111 and the second error amplifier circuit 112 requires the two PMOS transistors M113 and M114, two resistors R113 and R114, and the comparator circuit 113 in the conventional voltage regulator of FIG. 2, the operations of the first error amplifier circuit 3 and the switch SW can be controlled with the automatic switch circuit 5 formed of the PMOS transistor M11, the resistor R11, and the buffer 11 in the voltage regulator 10 of the second embodiment. Accordingly, it is possible to simplify circuits and to further reduce chip area.

In the above first and second embodiments, a description is given of the case where the second output transistor M2 is smaller in transistor size than the first output transistor M1. However, the present invention is not limited to this, and the first output transistor M1 may be the same as the second output transistor M2, or the first output transistor M1 may be smaller in transistor size than the second output transistor M2. In either case, it is possible to produce the same effects as described above in the first and second embodiments.

According to one embodiment of the present invention, there is provided a voltage regulator converting an input voltage input to an input terminal into a predetermined constant voltage, and outputting the converted voltage from a predetermined output terminal as an output voltage, the voltage regulator including: a first output transistor configured to output a first current according to an input first control signal from the input terminal to the output terminal; a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output the difference between the proportional voltage and the reference voltage and a second error amplifier circuit configured to amplify and output the difference between the proportional voltage and the reference voltage, the second error amplifier circuit consuming a smaller amount of current than the first error amplifier circuit, wherein the control circuit part is configured to control the output voltage by performing, in accordance with an externally input external control signal, one of controlling the operations of the first output transistor and the second output transistor using the first error amplifier circuit and controlling the operation of the second output transistor using the second error amplifier circuit.

According to the above-described voltage regulator, the output voltage is controlled by controlling the operations of the first output transistor and the second output transistor using the first error amplifier circuit or by controlling the operation of the second output transistor using the second error amplifier circuit, in accordance with an externally input external control signal.

As a result, when a large current is output from the output terminal, the output voltage is controlled with both the first output transistor and the second output transistor using the first error amplifier circuit, which consumes a large amount of current but operates at high speed. On the other hand, when a small current is output from the output terminal, it is possible to control the output voltage with the second output transistor using the second error amplifier circuit that consumes a small amount of current.

Accordingly, it is possible to reduce current consumption and chip area at the same time with a simple circuit, and by making the second output transistor smaller in size than the first output transistor, it is possible to achieve a good transient response to the output voltage also at the time of a light load operation mode in which a small current is output from the output terminal.

Additionally, in the above-described voltage regulator, the control circuit part may further include a switch configured to connect the control electrodes of the first output transistor and the second output transistor in accordance with the external control signal, the first error amplifier circuit may have an output thereof connected to the control electrode of the first output transistor and operate in accordance with the external control signal, and the second error amplifier circuit may have an output thereof connected to the control electrode of the second output transistor.

Additionally, in the above-described voltage regulator, the first error amplifier circuit may be configured to start operating when the external control signal is input so as to cause the switch to connect the control electrodes of the first output transistor and the second output transistor, and to stop operating when the external control signal is input so as to cause the switch to interrupt the connection of the control electrodes of the first output transistor and the second output transistor.

Additionally, in the above-described voltage regulator, the second output transistor may be configured to have a smaller transistor size and a smaller current driving capability than the first output transistor.

Additionally, in the above-described voltage regulator, the first output transistor, the second output transistor, and the control circuit part may be integrated into a single IC.

According to one aspect of the present invention, there is provided a voltage regulator converting an input voltage input to an input terminal into a predetermined constant voltage, and outputting the converted voltage from a predetermined output terminal as an output voltage, the voltage regulator including: a first output transistor configured to output a first current according to an input first control signal from the input terminal to the output terminal; a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output the difference between the proportional voltage and the reference voltage and a second error amplifier circuit configured to amplify and output the difference between the proportional voltage and the reference voltage, the second error amplifier circuit being configured to consume a smaller amount of current than the first error amplifier circuit, wherein the control circuit part is configured to determine the magnitude of a current output from the output terminal based on a voltage at the control electrode of the second output transistor, and to control the output voltage by performing, in accordance with the result of the determination, one of controlling the operations of the first output transistor and the second output transistor using the first error amplifier circuit and controlling the operation of the second output transistor using the second error amplifier circuit.

According to the above-described voltage regulator, the magnitude of a current output from the output terminal is determined based on a voltage at the control electrode of the second output transistor, and the output voltage is controlled by controlling the operations of the first output transistor and the second output transistor using the first error amplifier circuit or by controlling the operation of the second output transistor using the second error amplifier circuit, in accordance with the result of the determination. As a result, it is possible to produce the same effects as those described above, and also to automatically switch between a light load operation mode in which only the second output transistor is used and a heavy load operation mode in which the first output transistor and the second output transistor are used.

Additionally, in the above-described voltage regulator, the control circuit part may be configured to control the operations of the first output transistor and the second output transistor using the first error amplifier circuit when it determines that the current output from the output terminal is greater than or equal to a predetermined value, and to control the operation of the second output transistor using the second error amplifier circuit when it determines that the current output from the output terminal is less than the predetermined value.

Additionally, in the above-described voltage regulator, the control circuit part may further include a switch configured to connect a control electrode of the first output transistor and the control electrode of the second output transistor in accordance with an input third control signal; and an automatic switch circuit configured to control operations of the first error amplifier circuit and the switch in accordance with the voltage at the control electrode of the second output transistor, wherein the first error amplifier circuit may have an output thereof connected to the control electrode of the first output transistor, and operate in accordance with the third control signal from the automatic switch circuit, and the second error amplifier circuit may have an output thereof connected to the control electrode of the second output transistor.

Additionally, in the above-described voltage regulator, the automatic switch circuit may be configured to cause the first error amplifier circuit to operate, and to cause the switch to connect the control electrodes of the first output transistor and the second output transistor when it determines that the current output from the output terminal is greater than or equal to the predetermined value based on the voltage at the control electrode of the second output transistor.

Additionally, in the above-described voltage regulator, the automatic switch circuit may be configured to stop the operation of the first error amplifier circuit to reduce current consumption, and to cause the switch to interrupt the connection of the control electrodes of the first output transistor and the second output transistor when it determines that the current output from the output terminal is less than the predetermined value based on the voltage at the control electrode of the second output transistor.

Additionally, in the above-described voltage regulator, the second output transistor may be configured to have a smaller transistor size and a smaller current driving capability than the first output transistor.

Additionally, in the above-described voltage regulator, the first output transistor, the second output transistor, and the control circuit part may be integrated into a single IC.

The present invention is not limited to the specifically disclosed embodiments, and variations and modifications may be made without departing from the scope of the present invention.

The present application is based on Japanese Priority Patent Application No. 2006-235881, filed on Aug. 31, 2006, the entire contents of which are hereby incorporated by reference.

The invention claimed is:

1. A voltage regulator converting an input voltage input to an input terminal into a predetermined constant voltage, and outputting the converted voltage from a predetermined output terminal as an output voltage, the voltage regulator comprising:

a first output transistor configured to output a first current according to an input first control signal from the input terminal to the output terminal;

a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output a difference between the proportional voltage and the reference voltage and a second error amplifier circuit configured to amplify and output the difference between the proportional voltage and the reference voltage, the second error amplifier circuit being configured to consume a smaller amount of current than the first error amplifier circuit, wherein the control circuit part is configured to control the output voltage by performing, in accordance with an externally input external control signal, one of controlling the operations of the first output transistor and the second output transistor using the first error amplifier circuit and controlling the operation of the second output transistor using the second error amplifier circuit.

2. The voltage regulator as claimed in claim 1, wherein the control circuit part further comprises a switch configured to connect control electrodes of the first output transistor and the second output transistor in accordance with the external control signal, the first error amplifier circuit has an output thereof connected to the control electrode of the first output transistor, and operates in accordance with the external control signal, and the second error amplifier circuit has an output thereof connected to the control electrode of the second output transistor.

3. The voltage regulator as claimed in claim 2, wherein the first error amplifier circuit is configured to start operating in response to the external control signal being input so as to cause the switch to connect the control electrodes of the first output transistor and the second output transistor, and to stop operating in response to the external control signal being input so as to cause the switch to interrupt the connection of the control electrodes of the first output transistor and the second output transistor.

4. The voltage regulator as claimed in claim 1, wherein the second output transistor is configured to have a smaller transistor size and a smaller current driving capability than the first output transistor.

5. The voltage regulator as claimed in claim 1, wherein the first output transistor, the second output transistor, and the control circuit part are integrated into a single IC.

6. A voltage regulator converting an input voltage input to an input terminal into a predetermined constant voltage, and outputting the converted voltage from a predetermined output terminal as an output voltage, the voltage regulator comprising:

a first output transistor configured to output a first current according to an input first control signal from the input terminal to the output terminal;

a second output transistor configured to output a second current according to an input second control signal from the input terminal to the output terminal; and a control circuit part configured to control operations of the first output transistor and the second output transistor so that a voltage proportional to the output voltage output from the output terminal is equalized with a predetermined reference voltage, the control circuit part including a first error amplifier circuit configured to amplify and output a difference between the proportional voltage and the reference voltage and a second error amplifier circuit configured to amplify and output the difference between the proportional voltage and the reference voltage, the second error amplifier circuit being configured to consume a smaller amount of current than the first error amplifier circuit, wherein the control circuit part is configured to determine a magnitude of a current output from the output terminal based on a voltage at a control electrode of the second output transistor, and to control the output voltage by performing, in accordance with a result of the determination, one of controlling the operations of the first output transistor and the second output transistor using the first error amplifier circuit and controlling the operation of the second output transistor using the second error amplifier circuit.

7. The voltage regulator as claimed in claim 6, wherein the control circuit part is configured to control the operations of the first output transistor and the second output transistor using the first error amplifier circuit in response to determining that the current output from the output terminal is greater than or equal to a predetermined value, and to control the operation of the second output transistor using the second error amplifier circuit in response to determining that the current output from the output terminal is less than the predetermined value.

8. The voltage regulator as claimed in claim 6, wherein the control circuit part further comprises:

a switch configured to connect a control electrode of the first output transistor and the control electrode of the second output transistor in accordance with an input third control signal; and an automatic switch circuit configured to control operations of the first error amplifier circuit and the switch in accordance with the voltage at the control electrode of the second output transistor, wherein the first error amplifier circuit has an output thereof connected to the control electrode of the first output transistor, and operates in accordance with the third control signal from the automatic switch circuit, and the second error amplifier circuit has an output thereof connected to the control electrode of the second output transistor.

9. The voltage regulator as claimed in claim 8, wherein the automatic switch circuit is configured to cause the first error amplifier circuit to operate, and to cause the switch to connect the control electrodes of the first output transistor and the second output transistor in response to determining that the current output from the output terminal is greater than or equal to the predetermined value based on the voltage at the control electrode of the second output transistor.

10. The voltage regulator as claimed in claim 8, wherein the automatic switch circuit is configured to stop the operation of the first error amplifier circuit to reduce current consumption, and to cause the switch to interrupt the connection of the control electrodes of the first output transistor and the second output transistor in response to determining that the current output from the output terminal is less than the predetermined value based on the voltage at the control electrode of the second output transistor.

11. The voltage regulator as claimed in claim 6, wherein the second output transistor is configured to have a smaller transistor size and a smaller current driving capability than the first output transistor.

12. The voltage regulator as claimed in claim 6, wherein the first output transistor, the second output transistor, and the control circuit part are integrated into a single IC.

* * * * *